US005682647A

United States Patent [19]

Leifeld

[11] Patent Number: 5,682,647

[45] Date of Patent: Nov. 4, 1997

[54] APPARATUS FOR MOVING COILER CANS TO A SLIVER PRODUCING TEXTILE MACHINE

[75] Inventor: Ferdinand Leifeld, Kempen, Germany

[73] Assignee: Trützschler GmbH & Co. KG, Mönchengladbach, Germany

[21] Appl. No.: 617,328

[22] Filed: Mar. 18, 1996

[30] Foreign Application Priority Data

Mar. 18, 1995 [DE] Germany ..... 195 09 928.1

[51] Int. Cl.[6] ..... D01H 9/18; B65H 67/06; B65G 47/29; B65G 47/88

[52] U.S. Cl. ..... 19/159 A; 19/159 R; 198/345.3

[58] Field of Search ..... 19/159 A, 159 R; 198/345.3

[56] References Cited

U.S. PATENT DOCUMENTS

| | | | |
|---|---|---|---|
| 1,384,193 | 7/1921 | Hinchman . | |
| 2,924,323 | 2/1960 | Holben . | |
| 2,943,724 | 7/1960 | McCoy . | |
| 3,323,177 | 6/1967 | Binder et al. | 19/159 A |
| 4,096,939 | 6/1978 | Riggs et al. . | |
| 4,227,848 | 10/1980 | Kriechbaum et al. | 19/159 A X |
| 4,479,572 | 10/1984 | Merz | 198/345.3 |
| 4,506,777 | 3/1985 | Kampf | 198/345.3 X |
| 5,311,645 | 5/1994 | Schwalm et al. | 19/159 A |
| 5,366,062 | 11/1994 | Markin et al. | 198/345.3 |
| 5,500,986 | 3/1996 | Leifeld et al. | 19/159 A |

FOREIGN PATENT DOCUMENTS

| | | |
|---|---|---|
| 1326124 | 3/1963 | France . |
| 26 23 472 | 5/1989 | France . |
| 10 45 903 | 12/1958 | Germany . |
| 11 72 997 | 6/1964 | Germany . |
| 17 56 438 | 6/1974 | Germany . |
| 23 26 950 | 12/1974 | Germany . |
| 24 46 702 | 5/1975 | Germany . |
| 24 24 507 | 11/1975 | Germany . |
| 30 24 993 | 6/1984 | Germany . |
| 32 29 191 | 8/1991 | Germany . |
| 40 10 697 | 10/1991 | Germany . |
| 40 16 274 | 11/1991 | Germany . |
| 41 12 435 | 12/1992 | Germany . |
| 44 07 110 | 11/1994 | Germany . |
| 672477 | 11/1989 | Switzerland . |
| 1 245 631 | 9/1971 | United Kingdom . |
| 1 247 841 | 9/1971 | United Kingdom . |
| 1 487 592 | 10/1977 | United Kingdom . |
| 1 509 542 | 5/1978 | United Kingdom . |
| 2 069 959 | 9/1981 | United Kingdom . |
| 2 196 597 | 5/1988 | United Kingdom . |
| 39 38 206 | 7/1990 | United Kingdom . |
| 2 253 619 | 9/1992 | United Kingdom . |
| 90/11243 | 10/1990 | WIPO . |

*Primary Examiner*—John J. Calvert
*Attorney, Agent, or Firm*—Spencer & Frank

[57] ABSTRACT

A coiler can transporting assembly for advancing coiler cans in a transporting direction to a sliver-producing textile machine. The assembly includes coiler cans each having a bottom forming a conveying face; and a conveyor element having a discharge end and an upper transporting surface engaging the conveying face of the coiler cans when in an upright, standing position on the conveyor element. The conveying face and the transporting surface have a low friction value relative to one another. A can-stopping device is situated at a location along the conveyor element and has first and second states. In the first state the can-stopping device blocks advancement of a coiler can while the conveyor element continues to move in the transporting direction. In the second state the can-stopping device allows advancement of a coiler can therethrough.

14 Claims, 7 Drawing Sheets

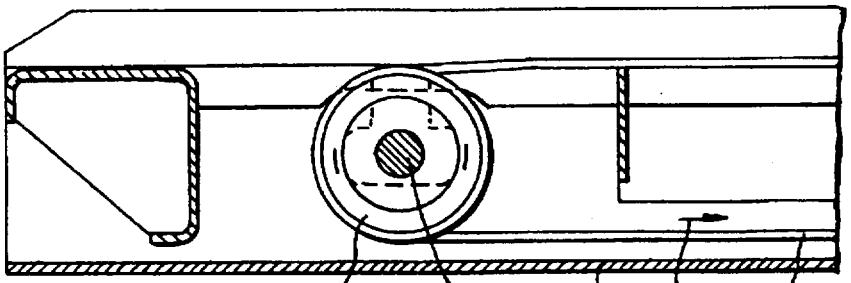
FIG. 4a
FIG. 4b
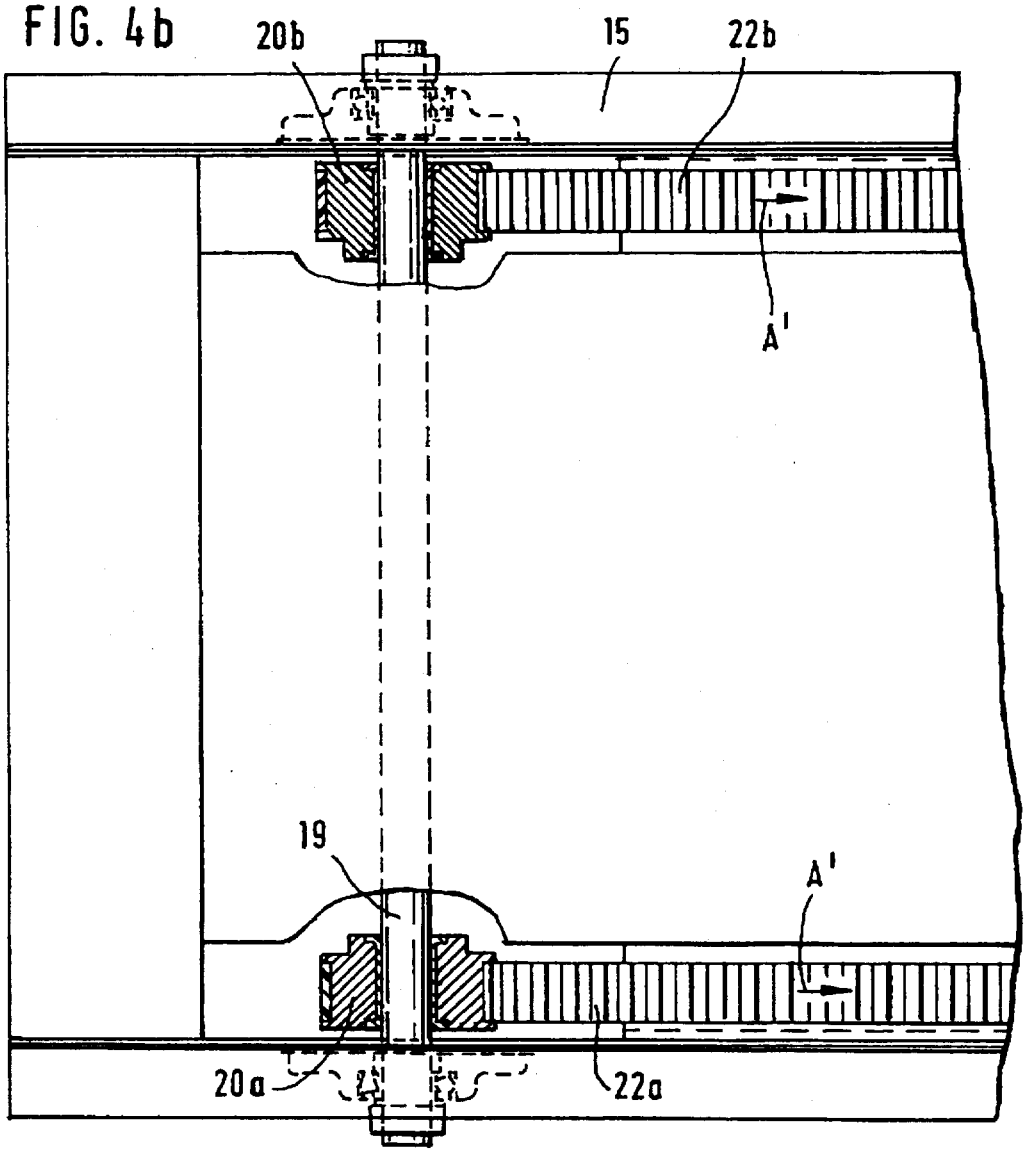

APPARATUS FOR MOVING COILER CANS TO A SLIVER PRODUCING TEXTILE MACHINE

CROSS REFERENCE TO RELATED APPLICATION

This application claims the priority of German Application No. 195 09 928.1 filed Mar. 18, 1995, which is incorporated herein by reference.

BACKGROUND OF THE INVENTION

This invention relates to an apparatus which is associated with a sliver processing textile machine, such as a card or a drawing frame and serves for advancing and presenting coiler cans to the fiber processing machine for being filled with sliver. The apparatus is of the type which includes a conveyor device having a driven conveying element such as a conveyor belt, a roller track or the like, coupled with an openable and closable coiler can blocking device.

In a known apparatus of the above-outlined type, disclosed, for example in German Offenlegungsschrift (application published without examination) 39 08 832, the coiler cans are advanced by a horizontally circulating, driven conveyor belt. The lateral surface of the coiler cans is situated between a reach of the conveyor belt, having a high coefficient of friction and a stationarily held railing. During transport the bottom rollers of the coiler cans roll on the floor of the spinning preparation plant. The known apparatus positively entrains the coiler cans along the entire conveying path and thus all coiler cans are simultaneously moved. It is not feasible to line up the coiler cans in a series without applying a pressing force and to separate the cans from one another. If a new empty can is to be advanced to the coiler can replacing device, in each instance the conveying apparatus has to be set in motion to simultaneously move all the coiler cans, that is, the supply of the leading can, the transport of all the cans and the adding of a new empty can are always necessarily coupled to one another. It is a further disadvantage of the conventional apparatus that the constructional outlay is substantial. Also, a lateral handling is prevented by the conveyor belt and the railing.

SUMMARY OF THE INVENTION

It is an object of the invention to provide an improved apparatus of the above-outlined type from which the discussed disadvantages are eliminated and which, in particular, ensures an improved conveyance and presentation of coiler cans and which permits the separation of the coiler cans in a structurally simple manner.

This object and others to become apparent as the specification progresses, are accomplished by the invention, according to which, briefly stated, the coiler can transporting assembly for advancing coiler cans in a transporting direction to a sliver-producing textile machine includes coiler cans each having a bottom forming a conveying face; and a conveyor element having a discharge end and an upper transporting surface engaging the conveying face of the coiler cans when in an upright, standing position on the conveyor element. The conveying face and the transporting surface have a low friction value relative to one another. A can-stopping device is situated at a location along the conveyor element and has first and second states. In the first state the can-stopping device blocks advancement of a coiler can while the conveyor element continues to move in the transporting direction. In the second state the can-stopping device allows advancement of a coiler can therethrough.

Thus, according to the invention, for supplying, removing and/or storing coiler cans at a sliver producing textile machine, the coiler cans are positioned on driven conveyor elements, such as conveyor belts and advanced against can-stopping devices. When the coiler cans have reached their destination, they are held by the can-stopping devices, while the conveyor element, such as a belt, continues to move and thus a relative sliding motion between the conveyor belt and the coiler cans takes place. In this manner, a structurally simple coiler can accumulator is provided which permits a conveyance, storage and separation of the coiler cans.

As the conveyor element advances, the slight sliding friction between the conveyor element and the bottom of the coiler cans is of importance for the accumulation of coiler cans, while for the conveyance of the cans, the pressure (gravity) of the coiler can bottom on the conveyor element is of significance.

If a coiler can is to be taken out of the accumulator, the can-stopping device (such as a gate) is placed in a releasing state and after the conveyor element, such as a conveyor belt, has run through a distance which corresponds to the diameter of the coiler, it is stopped, the designated coiler can is removed and the can-stopping device is again placed into its operative, can-blocking position. The conveyor element is activated and deactivated by a control device which cooperates with the control of a machine situated upstream and/or downstream of the can conveyor apparatus. The start of the conveyor element may be triggered manually by the operating person whereupon a period is triggered which corresponds to the longest possible conveyor path. Thereafter the conveyor drive automatically stops. Such an operation reduces the period during which relative sliding motion occurs between the coiler cans and the conveyor element and thus diminishes the wear on the belt and the cans.

Instead of a conveyor belt, two toothed belts may be used which move parallel and in unison. The two belts are spaced from one another at a distance which is in the order of magnitude of the diameter of the coiler cans. The two outer edges of the parallel belts have a distance which is preferably slightly greater than the outer can diameter in the region of the standing surface of the can. The can transport device and/or accumulator preferably cooperate with the can supplying and removing devices. The can supplying and/or removing device is expediently a coiler can replacing mechanism which may be a linear or rotary can exchanger. The accumulator may have sensors for detecting the coiler cans. The belts preferably run in protective troughs which are of low friction and wear-resistant material such as low-pressure polyethylene. Advantageously, the belts are individually driven. Expediently, a plurality of belts are simultaneously operated from a common drive. In the drive system reversal gears may be used. According to a further feature of the invention a centering device is provided for the coiler cans at the inlet end of the conveyor belt. The can surface which contacts the conveyor element may be constituted by a planar can bottom, an additional base plate or an annular attachment.

The invention further has the following additional advantageous features:

The conveying path of the conveyor element is adjustable when the can-blocking device is either in its blocking or in its pass-through state. The drive of the can-blocking device and the drive of the conveyor element are electrically connected to one another. An electronic control and regulating device, such as a microcomputer is provided, to which the drive for the sliver producing textile machine, the drive for the conveyor element and the drive for the can-blocking device are connected to coordinate the operation of the various components. Sensors, such as optical barriers may be provided for detecting the presence of the coiler cans. The can-blocking device may be constituted by an arm, roller, or the like of a can-replacing device which supplies an empty can to the sliver producing textile machine from the conveyor element. The conveyor element which supplies empty coiler cans slopes downwardly towards the sliver producing textile machine. The conveyor element which moves away full coiler cans slopes downwardly from the sliver producing textile machine. The can-blocking device may be formed by a detent or hook which immobilizes a coiler can on the running conveyor element by engaging from below into a recess provided in the coiler can.

BRIEF DESCRIPTION OF THE DRAWINGS

FIG. 4*a* is a schematic side elevational view of a terminal portion of a conveyor element of the preferred embodiment of the invention.

FIG. 4*b* is a schematic top plan view of the construction shown in FIG. 4*a*.

FIGS. 7*a*–11*a* are bottom plan views of various can bottom configurations.

FIGS. 7*b*–11*b* are schematic side elevational views of coiler can configurations, paired with FIGS. 7*a*–11*a*, respectively.

DESCRIPTION OF THE PREFERRED EMBODIMENTS

Figure 1A:
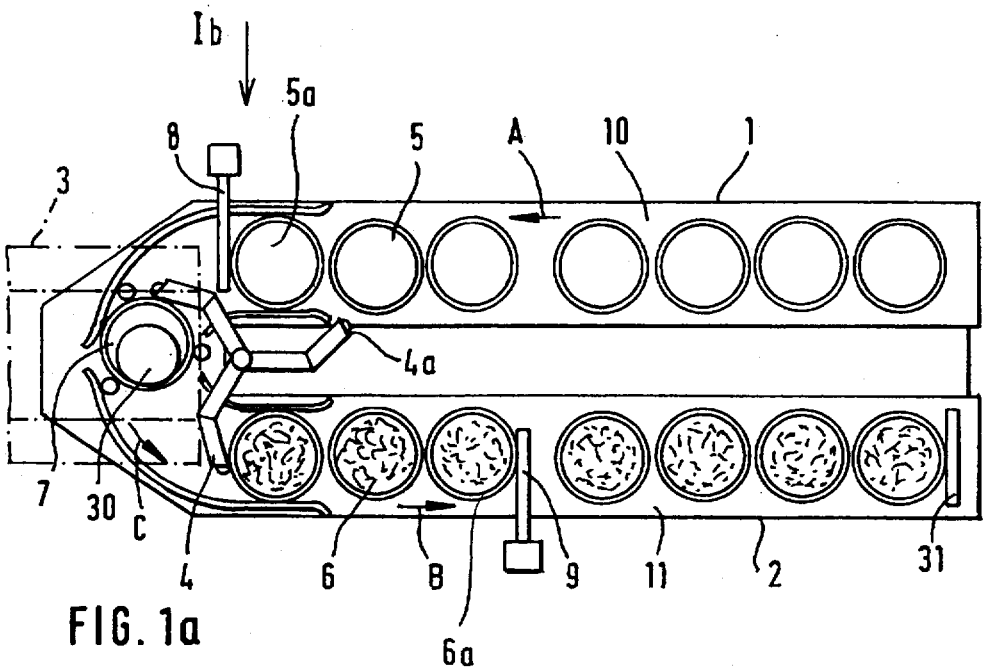
FIG. 1*a* is a schematic top plan view of a preferred embodiment of an apparatus according to the invention.

FIG. 1*a* shows a drawing frame 3 which may be, for example, an HS model high-output drawing frame manufactured by Trützschler GmbH & Co. KG, M önchengladbach, Germany. The drawing frame 3 has a drive 3*a*. With the drawing frame 3 an apparatus 1 and an apparatus 2 are associated for supplying empty coiler cans 5 to, and for moving coiler cans 6 filled with sliver away from the drawing frame 3, respectively. The empty cans 5 are advanced by the apparatus 1 in the direction of the arrow A, whereas the filled cans 6 are advanced by the apparatus 2 in the direction of the arrow B. Further, a coiler can replacing apparatus 4 is provided which may be a turnstile-type rotary can moving arrangement for moving, during the same turning motion, a full coiler can away from, and an empty coiler can into the operational range of a sliver-depositing coiler head 30 in a curvilinear path designated by the arrow C. The coiler can positioned underneath the coiler head 30 which deposits sliver into the coiler can, is designated at 7. The leading empty can 5*a* on the apparatus 1 cooperates with an openable and closable gate 8 whereas the leading full can 6*a* on the apparatus 2 cooperates with an openable and closable gate 9. The cans 5 are advanced on a conveyor 10 such as a conveyor belt, whereas the cans 6 are advanced on a conveyor 11 which also may be a conveyor belt. Downstream of the gate 9, as viewed in the direction of advance B a stationary, fixed gate 31 is disposed in the path of the cans.

Figure 1B:
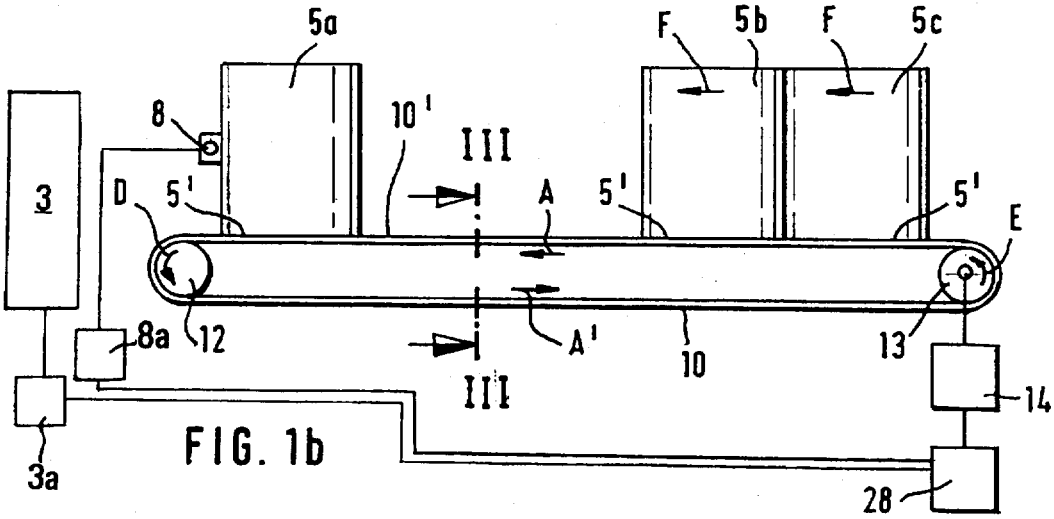
FIG. 1*b* is a schematic side elevational view of the construction shown in FIG. 1*a*, as viewed in the direction of the arrow Ib.

Turning to FIG. 1*b*, the conveyor belt 10 has an upper, horizontal run on which coiler cans 5*a*, 5*b* and 5*c* are positioned in an upright orientation. Stated differently, the coiler cans 5*a*, 5*b* and 5*c* stand on the conveyor belt 10 and exert a pressure by gravity on the outer surface 10' of the upper run of the conveyor belt 10. The conveyor belt 10 is supported by two end rollers 12 and 13, the latter being driven by a motor 14. The apparatus 2 has a conveyor belt 11 provided with a horizontal upper run which has an outer face 11'. The outer faces 10' and 11' of the conveyor belts 10 and 11, respectively and the conveying surfaces 5' and 6' of the coiler cans 5 and 6 oriented towards the belt surfaces 10', 11' of the respective conveyor belts 10 and 11 have a mutually low frictional coefficient and are smooth. Arrows D and E indicate the direction of rotation of the end rollers 12 and 13, respectively. The conveyor belt 11 may have its own drive motor or the two conveyor belts 10 and 11 may be driven by the common drive motor 14. The drive motor 14 is connected with an electronic control and regulating device 28 which is also connected to the drive 3*a* of the drawing frame 3 as well as to a drive 8*a* of the gate 8 to coordinate the operation of the drawing frame 3, the gate 8 and the conveyor belts 10, 11.

Figure 2A:
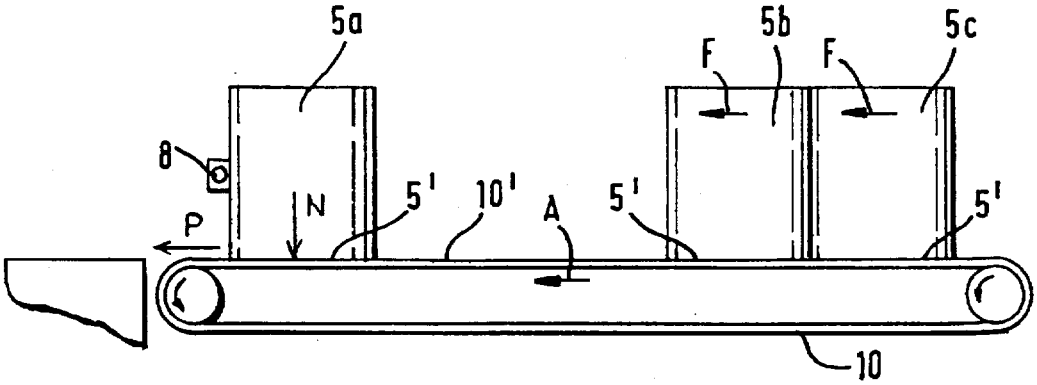
FIGS. 2*a*, 2*b* and 2*c* are views similar to FIG. 1*b*, illustrating various coiler can distribution patterns.
Figure 2B:
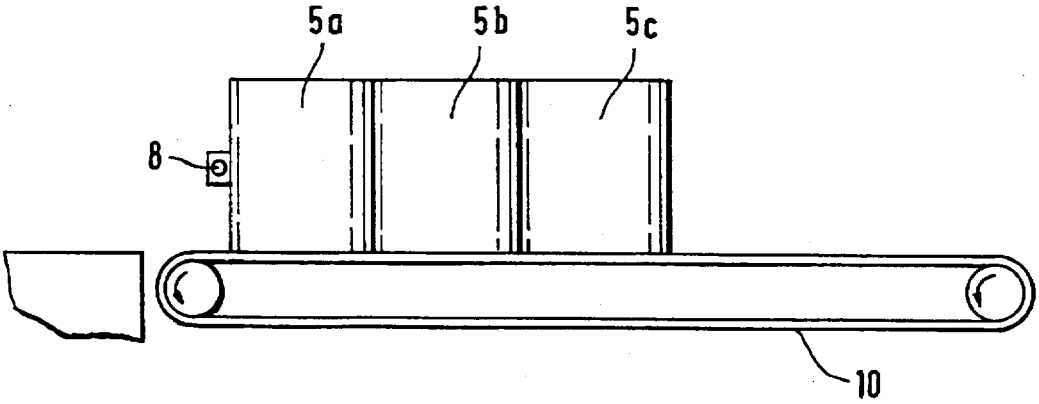
Figure 2C:
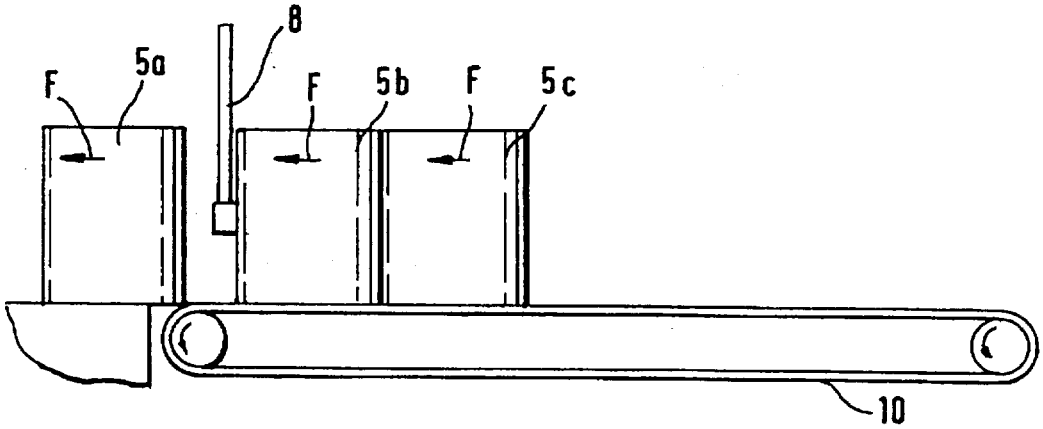

The conveyor belt 10 shown in FIGS. 2*a*, 2*b* and 2*c* runs in the conveying direction A. As shown in FIG. 2*a*, the leading can 5*a* abuts the closed gate 8 while the upper belt surface 10' which is in engagement with the lower conveying surface 5' of the coiler can 5*a* slides through in the direction A. At the same time, the coiler cans 5*b* and 5*c*, standing on the surface 10', are conveyed in the direction F until the can 5*b* abuts against the can 5*a*. Thereafter the surface 10' also slides through underneath the cans 5*b* and 5*c* which are immobile, similarly to the leading can 5*a*. To permit the leading coiler can 5*a* to be introduced into the drawing frame 3 (FIG. 1*a*), the gate 8 is lifted as shown in FIG. 2*c*. In this manner the retaining force exerted on the can 5*a* is removed and the can 5*a* is advanced by the belt 10 in the direction of the arrow F. At the same time, the cans 5*b* and 5*c* are also conveyed in the direction F until the coiler can 5*b* reaches the gate 8 whereupon the gate 8 is again closed to retain the coiler can 5*b* and the coiler can 5*c* therebehind.

The coiler can 5*a* exerts a force by virtue of its weight (gravity) on the belt surface 10'. According to FIGS. 2*a* and 2b, the slowly moved belt surface 10' presses with a normal force N upwardly on the stationary conveying surface 5' of the can 5a. The pulling force P of the belt 10 is opposed by the retaining force exerted by the gate 8. During the sliding friction between the surface 10' and the conveying face 5' the pulling force P=μ×N, where μ is the coefficient of friction. In the operational phase according to FIG. 2c, the retaining force of the gate 8 is removed by lifting the gate, so that the can 5a is advanced by the pulling force P of the belt 10 in the direction F.

Figure 3A:
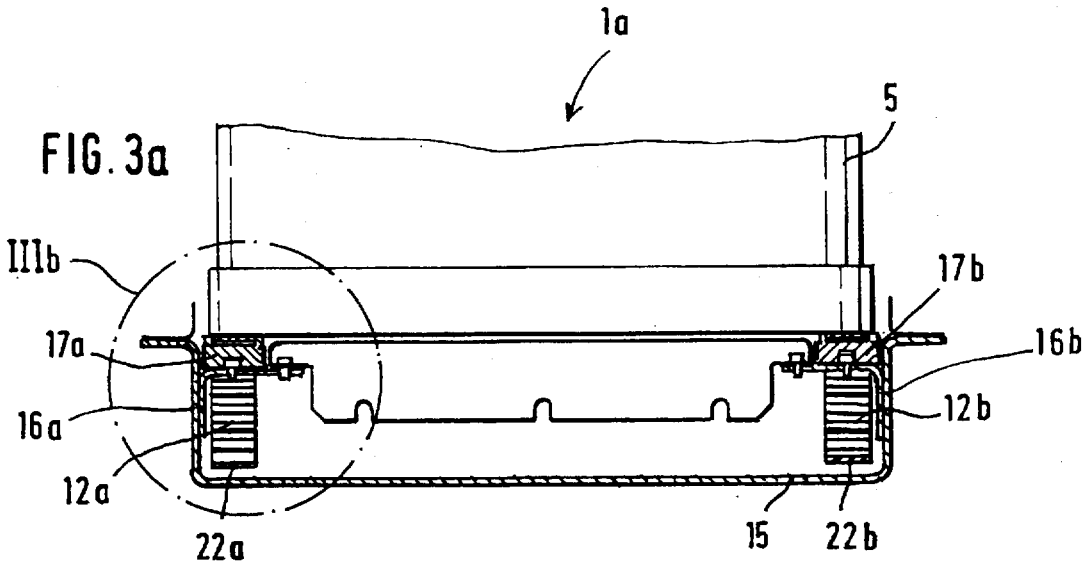
FIG. 3*a* is a schematic sectional end view taken along line III—III of FIG. 1*b*.
Figure 3B:
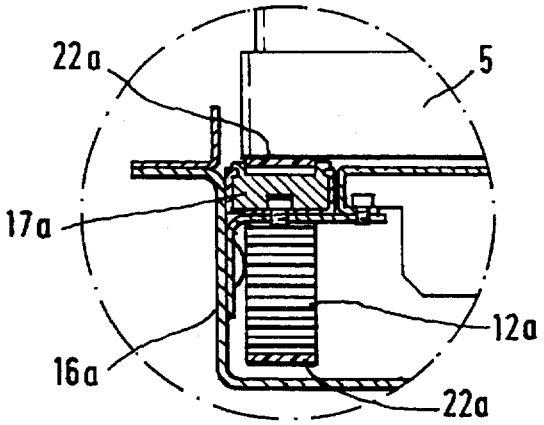
FIG. 3*b* is an enlarged view of the inset IIIb of FIG. 3*a*.
Figure 3C:
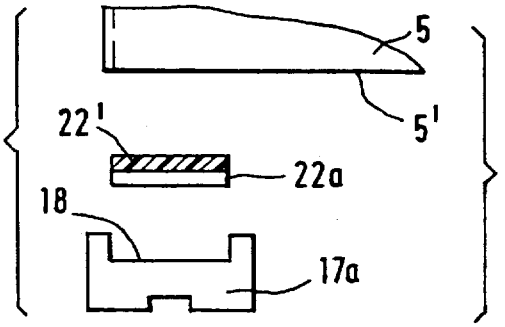
FIG. 3*c* is an exploded view of a protective trough, a toothed belt and a coiler can.

Turning to FIGS. 3a, 3b and 3c, in a housing 15 parallel-spaced toothed belts 22a, 22b are arranged to serve as conveying elements. On both sides of a holding element 16a, 16b stationarily affixed supporting troughs 17a, 17b are provided which extend in the longitudinal direction of the apparatus 1a. On the upper side in each support trough 17a, 17b a longitudinal groove 18 of rectangular cross-sectional outline is provided which accommodates the lower zone of the upper run of the respective belts 22a, 22b. The respective upper zones extend beyond the longitudinal groove 18 and are, by means of their respective outer surfaces 22', in engagement with the lower conveying surface 5' of the coiler can 5 as shown in the exploded view of FIG. 3c. In this manner the support troughs 17a, 17b support the can 5 and the toothed belts 22a, 22b and at the same time form a guiding element for the toothed belts 22a, 22b.

Figure 5:
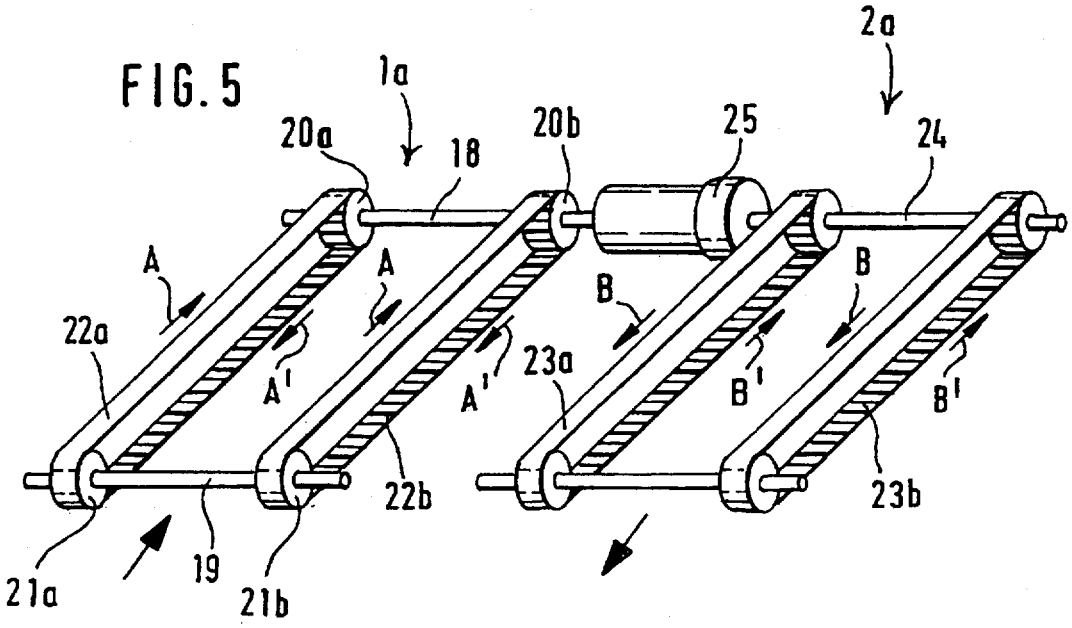
FIG. 5 is a perspective view of conveying elements for moving empty and full coiler cans.

FIGS. 4a and 4b show an end region of the toothed belts 22a, 22b. In the upwardly open housing 15 a shaft 18 supports two end sprockets 20a, 20b about which the respective endless toothed belts 22a, 22b are trained. As shown in FIG. 5, at the other, opposite end region of the toothed belts 22a, 22b a shaft 19 supports two end sprockets 21a, 21b about which the respective endless toothed belts 22a, 22b are trained. As also shown in FIG. 5, between the shaft 18 of the conveyor apparatus 1a which includes the toothed belts 22a, 22b and the shaft 24 of the conveyor apparatus 2a which includes the toothed belts 23a, 23b, a reversing gear 25 is provided so that the conveying devices of the apparatuses 1a and 2a may be driven by a driving arrangement, such as the drive 14 illustrated in FIG. 1b.

Figure 6:
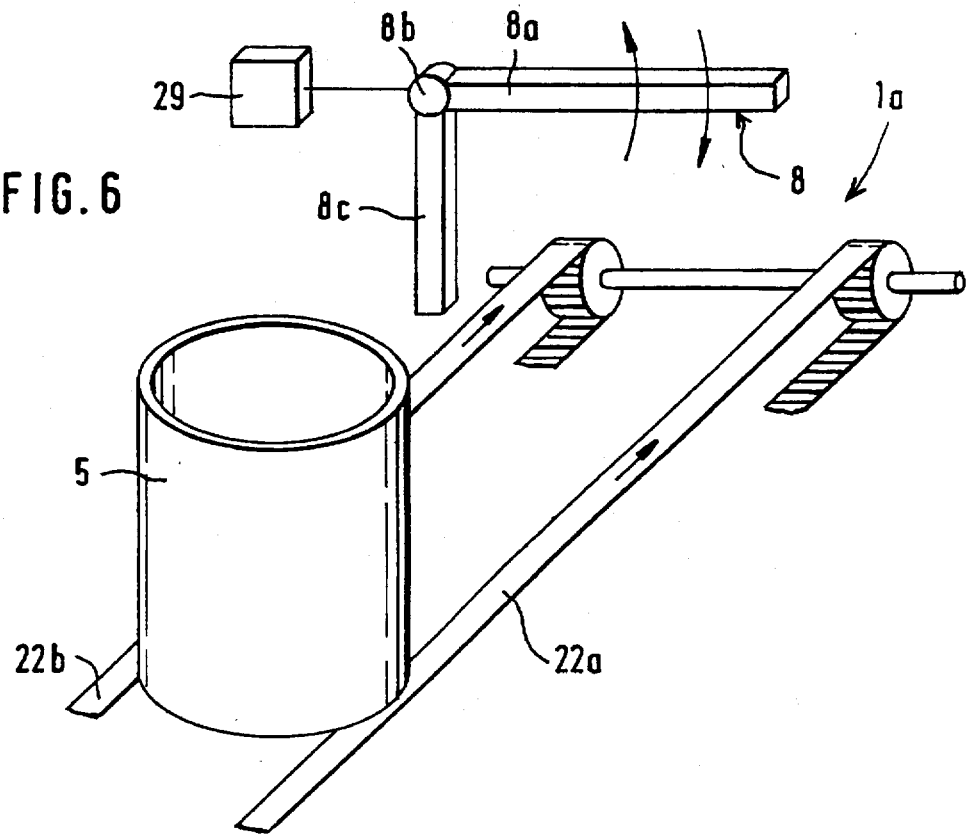
FIG. 6 is a schematic perspective view of a retaining gate for stopping a coiler can.

In FIG. 6 the gate 8 is shown in more detail. It includes a gate bar 8a which is swingable in a vertical plane between an operative (blocking) position and an open (pass-through) position about an articulation 8b provided on a stationary vertical post 8c. The movement of the gate 8 is controlled by an actuator 29. The gate 9 shown in FIG. 1a is similarly constructed.

It is to be understood that the can-stopping device may be of a construction other than the described gates 8 and 9. Thus, the can-stopping device may have a hook or pawl mechanism which may engage from below into an annulus, a groove or a recess provided in the coiler can.

Figure 7A:
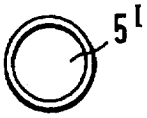
Figure 7B:
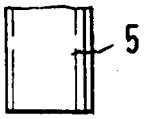

The coiler can has, according to FIGS. 7a and 7b, a circular cross-sectional outline. The underface of the can bottom, having a circular area, constitutes the conveying surface 5'.

Figure 8A:
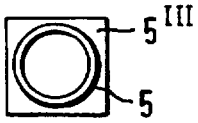
Figure 8B:
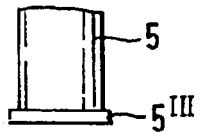
Figure 9A:
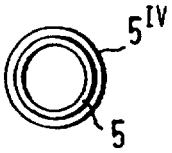
Figure 9B:
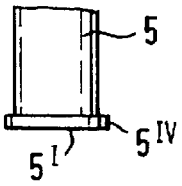
Figure 10A:
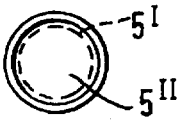
Figure 10B:
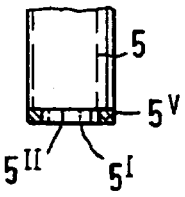
Figure 11A:
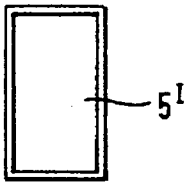
Figure 11B:
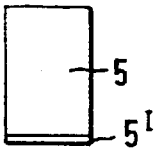

Turning to FIGS. 8a and 8b, the coiler can 5 of circular cross-sectional outline is mounted on a square bottom $5^{III}$, whereas in FIGS. 9a and 9b a coiler can is shown which has a circular bottom $5^{IV}$. The bottom plates $5^{III}$ and $5^{IV}$ project horizontally beyond the lateral surface of the can 5 and thus constitute a spacer between adjoining cans, preventing the lateral can faces from contacting one another. According to FIGS. 10a and 10b, underneath the can bottom $5^{II}$ a circular bottom plate $5^{V}$ is provided. FIGS. 11a and 11b show a coiler can 5 having an elongated, rectangular, horizontal cross-sectional outline.

Figure 12:
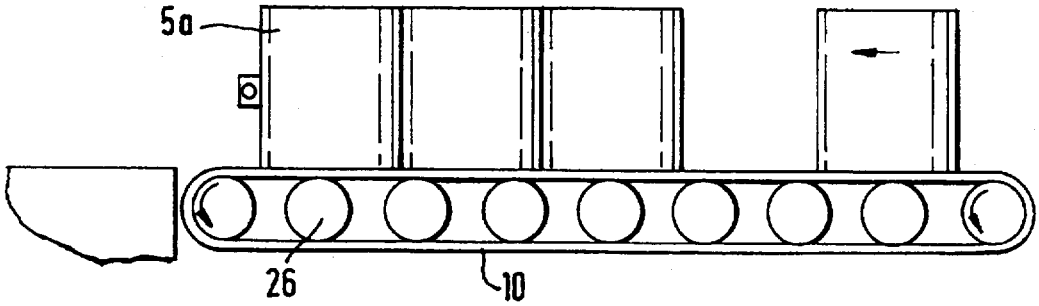
FIG. 12 is a schematic side elevational view of a preferred embodiment showing support rolls.

According to FIG. 12, between the upper and the lower runs of the conveyor belt 10 (or between the upper and lower runs of the toothed belts 22a, 22b of FIG. 3a) rotatable supporting rollers 26 are disposed. The same arrangement may be provided between the upper and lower runs of the respective toothed belts 22a, 22b, 23a and 23b.

Figure 13A:
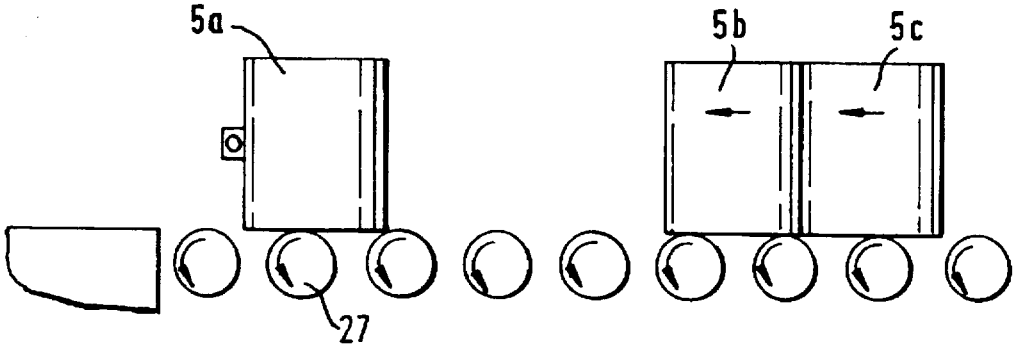
FIG. 13*a* is still another embodiment of the invention including a roller track.
Figure 13B:
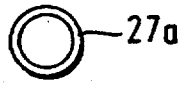
FIG. 13*b* is a side elevational detail of the structure shown in FIG. 13*a*.

In FIG. 13a, the conveyor device is composed of a roller track formed of driven conveyor rollers 27 which have a smooth upper surface which, as shown in FIG. 13b, may be a low-friction coating 27a.

Figure 14A:
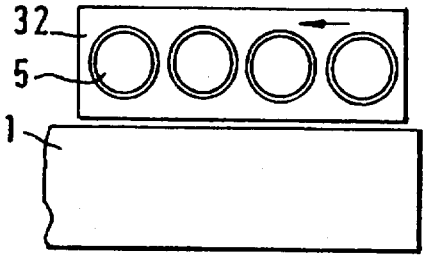
FIG. 14*a* illustrates the embodiment shown in FIG. 1*a*, together with a can transporting carriage.
Figure 14B:
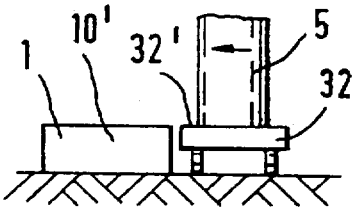
FIG. 14*b* is a schematic front elevational view of the construction shown in FIG. 14*a*.

According to FIGS. 14a, 14b, the empty cans 5 may be moved to the apparatus 1 by a can transporting carriage 32. Similarly, the full cans 6 may be moved away from the apparatus 2 by a transporting carriage (not shown). The transporting carriage 32 may, for example, receive four coiler cans and laterally approach the conveyor apparatus 1. According to FIG. 14b, the supporting surfaces 32' of the carriage 32 and the upper surfaces 10' of the conveyor 10 are at the same height level so that the cans may be moved between the carriage 32 and the conveyor 10 without any vertical step.

It will be understood that the above description of the present invention is susceptible to various modifications, changes and adaptations, and the same are intended to be comprehended within the meaning and range of equivalents of the appended claims.

What is claimed is:

1. A sliver processing system comprising (a) a sliver-producing textile machine;

(b) a first drive means for operating said sliver-producing textile machine;

(c) coiler cans each having a bottom forming a conveying face;

(d) a coiler can transporting assembly for advancing said coiler cans in a transporting direction to said sliver-producing textile machine; said coiler can transporting assembly including (1) a conveyor element having a discharge end and an upper transporting surface engaging the conveying face of the coiler cans when in an upright, standing position on the conveyor element; said conveying face and said transporting surface having a low friction value relative to one another;

(2) a second drive means for moving said conveyor element in said transporting direction;

(3) a can-stopping device situated at a location along said conveyor element and having first and second states; in said first state said can-stopping device blocks advancement of a coiler can while said first drive means continues to move said conveyor element in said transporting direction; in said second state said can-stopping device allows advancement of a coiler can therethrough;

(4) a third drive means for placing said can-stopping device in one of said states; and (e) a control and regulating device connected to said first, second and third drive means for coordinating an operation between said sliver-producing textile machine, said conveyor element and said can-stopping device.

2. The system as defined in claim 1, wherein said conveyor element comprises a conveyor belt.

3. The system as defined in claim 1, wherein said conveying face of said coiler cans is smooth.

4. The system as defined in claim 1, further comprising a coiler can replacing device situated at said discharge end of said conveyor element from moving a coiler can from said discharge end into a sliver depositing zone of a sliver producing textile machine.

5. The system as defined in claim 1, wherein said conveyor element is horizontally oriented.

6. The system as defined in claim 1, further comprising a coiler can transporting carriage for carrying empty coiler cans to said conveyor element.

7. The system as defined in claim 6, wherein said carriage includes a coiler can supporting surface positioned at a same height level as said transporting surface of said conveyor element.

8. A coiler can transporting assembly for advancing coiler cans in a transporting direction to a sliver-producing textile machine, comprising (a) coiler cans each having a bottom forming a conveying face;

(b) a conveyor element having a discharge end and an upper transporting surface engaging the conveying face of the coiler cans when in an upright, standing position on the conveyor element; said conveying face and said transporting surface having a low friction value relative to one another; said conveyor element including two parallel-spaced conveyor belts engaging said conveying surface of each said coiler can at locations spaced in a direction perpendicular to said transporting direction;

(c) a first drive means for moving said conveyor belts in said transporting direction;

(d) a can-stopping device situated at a location along said conveyor belts and having first and second states; in said first state said can-stopping device blocks advancement of a coiler can while said first drive means continues to move said conveyor belts in said transporting direction; in said second state said can-stopping device allows advancement of a coiler can therethrough; and (e) second drive means for placing said can-stopping device in one of said states.

9. The coiler can transporting assembly as defined in claim 8, further comprising two stationary, parallel-spaced supporting troughs extending below and parallel to respective said conveyor belts; said conveyor belts being received in said troughs and having an upper portion projecting beyond said troughs and including said transporting surface.

10. The coiler can transporting assembly as defined in claim 9, wherein said troughs are of a wear-resistant plastic having a low coefficient of friction.

11. A coiler can transporting assembly for advancing coiler cans in a transporting direction to a sliver-producing textile machine, comprising (a) coiler cans each having a bottom forming a conveying face;

(b) a first conveyor element for advancing empty coiler cans to the sliver-producing textile machine; said first conveyor element having a discharge end and an upper transporting surface engaging the conveying face of the coiler cans when in an upright, standing position on the first conveyor element; said conveying face and said transporting surface having a low friction value relative to one another;

(c) a second conveyor element for advancing full coiler cans from the sliver-producing textile machine; said second conveyor element having an upper transporting surface engaging the conveying face of the coiler cans when in an upright, standing position on the second conveyor element; said conveying face and said transporting surface of said second conveyor element having a low friction value relative to one another;

(d) a first drive means for moving said first and second conveyor elements;

(e) a first can-stopping device situated at a location along said first conveyor element and having first and second states; in said first state said first can-stopping device blocks advancement of a coiler can while said first drive means continues to move said first conveyor element; in said second state said first can-stopping device allows advancement of a coiler can therethrough;

(f) a second can-stopping device situated at a location along said second conveyor element and having first and second states; in said first state said second can-stopping device blocks advancement of a coiler can while said first drive means continues to move said second conveyor element; in said second state said second can-stopping device allows advancement of a coiler can therethrough; and (g) second drive means for placing said first and second can-stopping devices in one of said states.

12. The coiler can transporting assembly as defined in claim 11, wherein said first drive means comprises a single motor driving said first and second conveyor elements and a reversing gear for driving said first and second conveyor elements in opposite directions.

13. The coiler can transporting assembly as defined in claim 11, further comprising a coiler can transporting carriage for carrying empty coiler cans to said first conveyor element and for moving away full coiler cans from said second conveyor element.

14. The coiler can transporting assembly as defined in claim 13, wherein said carriage includes a coiler can supporting surface positioned at a same height level as said transporting surface of said first and second conveyor elements.

* * * * *